US005755355A

United States Patent [19]

Timmerman et al.

[11] Patent Number: 5,755,355

[45] Date of Patent: May 26, 1998

[54] PAD INCLUDING COADHESIVELY ADHERED SHEETS

[75] Inventors: Lee A. Timmerman, Mankato Township; Randall M. Mills, North Mankato; Michael S. Groess, Oakdale; Robert P. Molenda, Stillwater, all of Minn.

[73] Assignee: Minnesota Mining and Manufacturing Company, St. Paul, Minn.

[21] Appl. No.: 574,445

[22] Filed: Dec. 15, 1995

[51] Int. Cl.[6] ..... B65H 1/00

[52] U.S. Cl. ..... 221/33; 428/202

[58] Field of Search ..... 221/33, 45, 63, 221/46, 47, 25; 428/201, 206, 202

[56] References Cited

U.S. PATENT DOCUMENTS

| | | | |
|---|---|---|---|
| 4,102,253 | 7/1978 | Gannicott | 93/93 C |
| 4,653,666 | 3/1987 | Mertens | 221/45 |
| 4,781,306 | 11/1988 | Smith | 221/33 |
| 4,828,243 | 5/1989 | Ebihara | 271/3.1 |
| 4,835,947 | 6/1989 | Langen et al. | 53/542 |
| 5,011,132 | 4/1991 | Guttinger et al. | 271/315 |
| 5,080,255 | 1/1992 | Windorski | 221/45 |
| 5,397,117 | 3/1995 | Mertens | 221/33 |
| 5,472,240 | 12/1995 | Davies | 283/116 |

FOREIGN PATENT DOCUMENTS

| | | | |
|---|---|---|---|
| 0080707 | 6/1983 | European Pat. Off. | 221/33 |
| 9414614 | 7/1994 | European Pat. Off. . | |
| WO 94/14614 | 7/1994 | WIPO . | |

OTHER PUBLICATIONS

U.S. Patent Application No. 08/285,882 filed Aug. 4, 1994.

International Search Report PCT/US96/18044.

*Primary Examiner*—Kenneth Noland

*Attorney, Agent, or Firm*—William L. Huebsch

[57] ABSTRACT

A pad comprising a plurality of flexible sheets in a stack, and padding means for releasably adhering parts of the major surfaces of adjacent sheets in the stack together to maintain the sheets in the stack. That padding means is provided in that at least some of said sheets having patterns of coadhesive coated on their major surfaces, which patterns of coadhesive are adhered to patterns of coadhesive on adjacent sheets in the stack and releasably adhere parts of the major surfaces of adjacent sheets in the stack together in surface to surface relationship until the patterns of coadhesive are peeled apart.

23 Claims, 2 Drawing Sheets

PAD INCLUDING COADHESIVELY ADHERED SHEETS

TECHNICAL FIELD

The present invention relates to pads of flexible sheets and to methods for making such pads from sheet material.

BACKGROUND ART

Pads of flexible paper sheets sometimes called scratch pads or writing pads have long been available in various sizes, with various numbers of sheets, and in different configurations including rectangular and other peripheral shapes. The sheets in such pads can, optionally, be printed with indicia including lines, pictures, or various written information which may include, for example, the names of persons, companies or corporations, or which can provide a form to be used by a person or a business (e.g., a form that can be filled in to advise a person of a phone call, or a form that can be filled in to order a product or to enter a drawing).

Such pads are often made by forming large master sheets that are either printed or unprinted, assembling the master sheets together into a master pad with a stiff back sheet as the bottom most sheet, cutting a plurality of pads of a desired size from the master pad through the use of a shear or die, and then applying a padding compound (e.g., a water or organic solvent based padding compound or a hot melt adhesive padding compound) along edge surfaces of the pads. Individual sheets can then be removed from the tops of the pads by peeling them away from the padding compound. In some such pads (typically with a large amount of sheets that form a pad generally in the shape of cube) graphics for purposes such as advertising or decoration are printed along exposed edges of the sheets in the pad and along the padding compound adhering the sheets in the pad together. Such printing will have a different appearance along the padding compound than along the edges of the sheets, which can be undesirable.

Pads of flexible paper sheets having bands of pressure sensitive adhesive on major surfaces adjacent edges of the sheets that adhere the sheets together in the pads have been available for some time under the trade name "Post-it" (™) brand notes from Minnesota Mining and Manufacturing Company, St. Paul, Minn. Such pads are available with the bands of repositionable pressure sensitive adhesive all along edges of the sheets positioned at one side surface of the stack. Additionally, such pads are available with the band of pressure sensitive adhesive on each successive sheet in the pad along an opposite side surface of the pad as is taught in U.S. Pat. No. 4,781,306 (Smith). This latter pad structure facilitates dispensing of the sheets of such pads from dispensers of the types described in U.S. Pat. Nos. 4,781,306 (Smith), 4,653,666 (Mertens), and 5,080,255 (Windorski). Pads of either of those types can have graphics printed on the edges of the sheets along all of their side surfaces and those graphics can have a similar appearance on all sides of the pad. Providing the band of pressure sensitive adhesive on the sheets in such a pad adds expense to the pad, however, and for some purposes that band of pressure sensitive adhesive on sheets removed from the pad is not needed, or can even be undesirable.

DISCLOSURE OF INVENTION

The present invention provides a pad of flexible sheets (e.g., paper or polymeric sheets) which, like the prior art pads described above that are formed using padding compound, is inexpensive to make and can have sheets removed from it that do not bear bands of adhesive that will adhere to most common surfaces; but which, unlike those prior art pads can, if desired, be printed on all sides of the stack to provide a uniform appearance for those sides, and can also be adapted to be dispensed from dispensers of the types described in U.S. Pat. Nos. 4,781,306 (Smith), 4,653,666 (Mertens), and 5,080,255 (Windorski).

According to the present invention there is provided a pad including a stack of flexible sheets, and padding means for releasably adhering parts of the major surfaces of adjacent sheets in the stack together until sheets are pealed away from the pad. That padding means comprises at least some of the sheets having patterns of coadhesive coated on their major surfaces and adhered to patterns of coadhesive on adjacent sheets in the stack to releasably adhere parts of the major surfaces of those adjacent sheets together in surface to surface relationship until the patterns of coadhesive are peeled apart.

The term "coadhesive" as used herein means an adhesive material that when adhered in a thin layer to a major surface of a first sheet of paper or polymeric material and dried (1) will remain adhered to that surface, (2) will not adhere upon contact to most other materials including a persons fingers; (3) will releasably adhere to a thin layer of that same adhesive material on a major surface of a second substrate, and (4) can be pealed away from that layer on the second substrate with most of the adhesive material on both sheets remaining on the major surface of the sheet to which they were originally adhered. An example of such a coadhesive material is the natural latex adhesive available from H.B. Fuller, Co., St. Paul, Minn., under the trade designation #W-593.

Thus, while patterns of coadhesive can adhere sheets in the pad together, those patterns of coadhesive will not readily adhere to most other surfaces, so that the sheets will not become adhered to most surfaces after they are removed from the pad. Those patterns of coadhesive can, however, be re-adhered to other patterns of coadhesive, so that, if desired, sheets from the pad can be re-adhered into the pad after they have been removed.

The patterns of coadhesive could be in many different shapes, including areas of adhesive at the centers of the sheets that could be any shape such as circular, rectangular, etc., and are particularly useful when applied as narrow stripes or bands (e.g., 3/32 to ½ inch wide). Some or all of the sheets in the pad that have sheets along both of their major surfaces can each have a first band of coadhesive on their first major surface and can have a second band of coadhesive on their second major surface, with both bands being adjacent the same edge. This can provide the most common form of pad in which all sheets are bound into the pad along the same side surface of the pad.

Alternatively, some or all of the sheets in the pad that have sheets along both of their major surfaces can each have a first band of coadhesive on one of their major surfaces adjacent one edge and can have a second band of coadhesive on their other major surface adjacent a second opposite edge. This can provide a form of pad generally of the type described in U.S. Pat. No. 4,781,306 (Smith), sheets from which pad can be withdrawn seriatim when the pad is in a dispenser of the types described in U.S. Pat. Nos. 4,781,306 (Smith), 4,653,666 (Mertens), and 5,080,255 (Windorski).

Any such type of pad according to the present invention has a plurality of side surfaces defined by the edges of the sheets. If there are a large number of sheets in the pad, each of those side surfaces can have graphics printed on the edges of the sheets so that all of the side surfaces of the pad can look similar, which for example, is desirable in a pad in the shape of a cube used for advertising purposes.

The padding means in a pad according to the present invention can also include some sheets that have pressure sensitive adhesive in a band or other pattern on one of their major surfaces that releasably adheres parts of the major surfaces of adjacent sheets in the stack together to maintain the sheets in the stack. For example, alternating pairs of adjacent sheets in the stack from the top to the bottom of the stack can be adhered together by two bands of coadhesive and by one band of pressure sensitive adhesive, respectively. In that case (1) those bands of coadhesive and those bands of pressure sensitive adhesive can be along edges on the same side of the stack which provides the more conventional form of pad, or (2) those bands of coadhesive can be along edges on the opposite sides of the stack from those bands of pressure sensitive adhesive which can allow sheets from the pad to be dispensed through the dispensers described above.

BRIEF DESCRIPTION OF DRAWING

The present invention will be further described with reference to the accompanying drawing wherein like reference numerals refer to like parts in the several views, and wherein.

DETAILED DESCRIPTION

Figure 2:
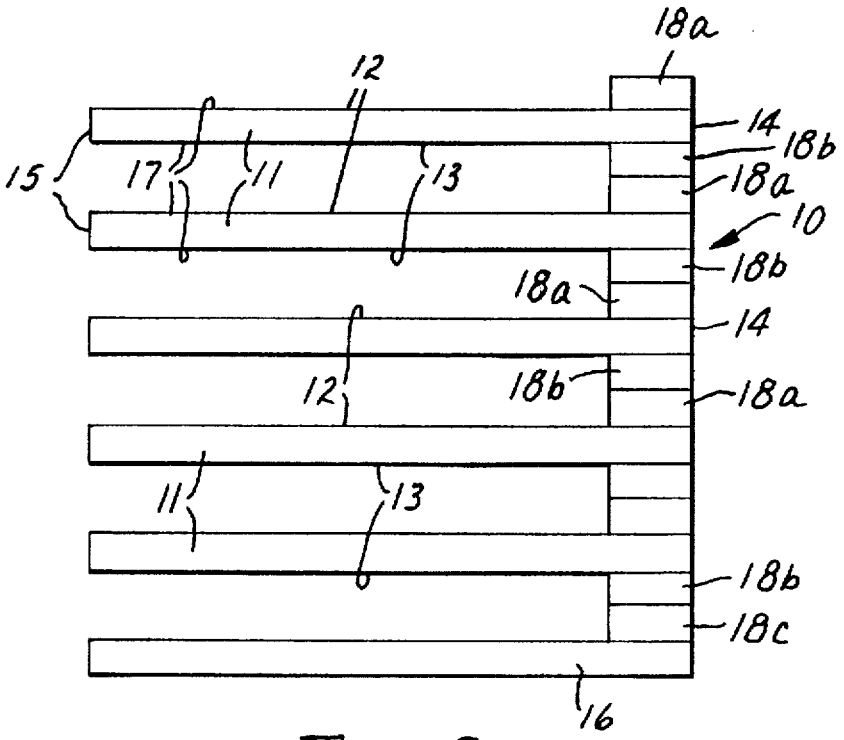
FIG. 2 is a much enlarged, not to scale, schematic side view of a portion of the pad of FIG. 1.
Figure 1:
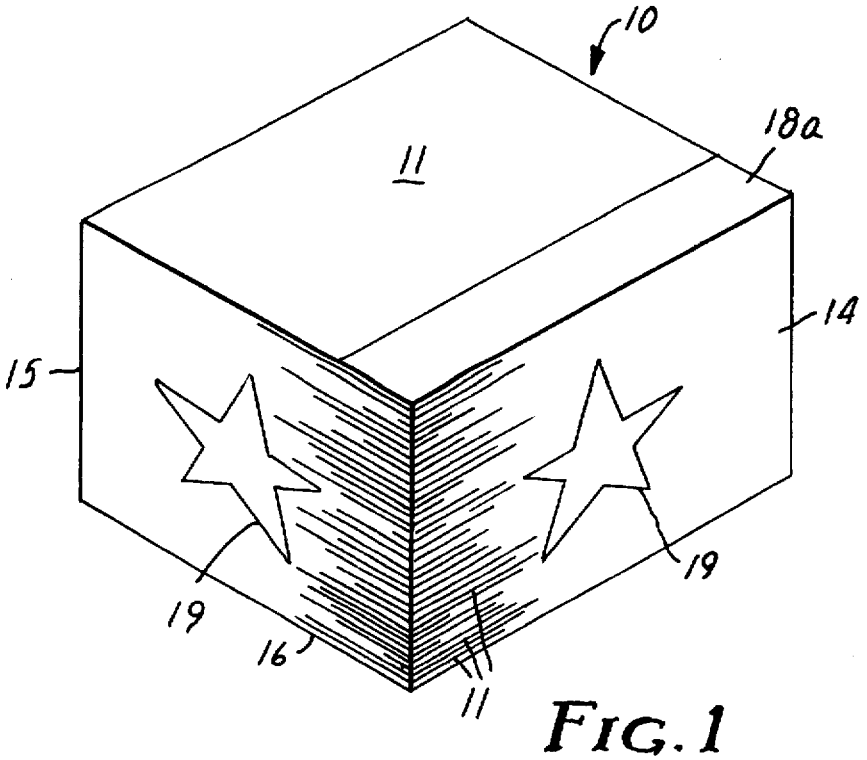
FIG. 1 is a perspective view of a first embodiment of a pad of flexible sheets according to the present invention.

Referring now to FIGS. 1 and 2 of the drawing, there is shown a first embodiment of a pad of sheets according to the present invention generally designated by the reference numeral 10.

Generally the pad 10 comprises a plurality of non folded flexible sheets 11 of the same peripheral size and shape (e.g., sheets of paper or polymeric material), each of which sheets 11 has opposite first and second major surfaces 12 and 13 extending between first and second opposite edges 14 and 15 (see FIG. 2). The sheets 11 are disposed in a stack one on top of another with their peripheral edges aligned. Each of the sheets 11 can, optionally, have graphics 17 printed on either or both of its major surfaces 12 and 13. The pad 10 includes padding means for releasably adhering parts of the first and second major surfaces 12 and 13 of adjacent sheets 11 in the pad 10 together to maintain the sheets 11 in the stack. That padding means comprises each of the sheets 11 having a pattern or first band **18*a* of coadhesive on its first major surface 12 adjacent its first edge 14, and a pattern or second band 18*b* of coadhesive on its second major surface 13 adjacent its first edge 14. The sheets 11 are stacked with the bands 18*a* and 18*b* of coadhesive on each sheet 11 that has two other of the sheets 11 along its major surfaces 12 and 13 adhered to the bands 18*a* and 18*b* of coadhesive on adjacent sheets 11 in the pad 10 to releasably adhere parts of the first and second major surfaces 12 and 13 of adjacent sheets 11 in the pad 10 together and maintain the sheets 11 in the pad 10. The adhered together bands 18*a* and 18*b* of coadhesive on the sheets 11 retain the adjacent sheets 11 in surface to surface relationship until the bands 18*a* and 18*b*** of coadhesive are peeled apart.

The pad 10, as illustrated, can also include a stiff bottom sheet 16 having a band **18*c* of coadhesive adhered to the band 18*b* of coadhesive on the bottom most sheet 11 in the stack, and optionally could also have a special top sheet (not shown) having a band of coadhesive adhered to the band 18*a* of coadhesive on the adjacent uppermost sheet 11** in the stack.

The pad 10 is generally in the shape of a cube (see FIG. 1) and has a plurality of or four side surfaces defined by the edges of the sheets 11. Each of those four side surfaces can optionally, as illustrated, be printed with graphics 19 on the edges of the sheets 11. Since (as with the other stacks described below) the padding means for the pad 10 is between the sheets 11 in the pad 10 rather than along one of the side surfaces of the pad 10, those graphics 19 can, if desired, have a similar appearance on all side surfaces of the pad 10.

Figure 3:
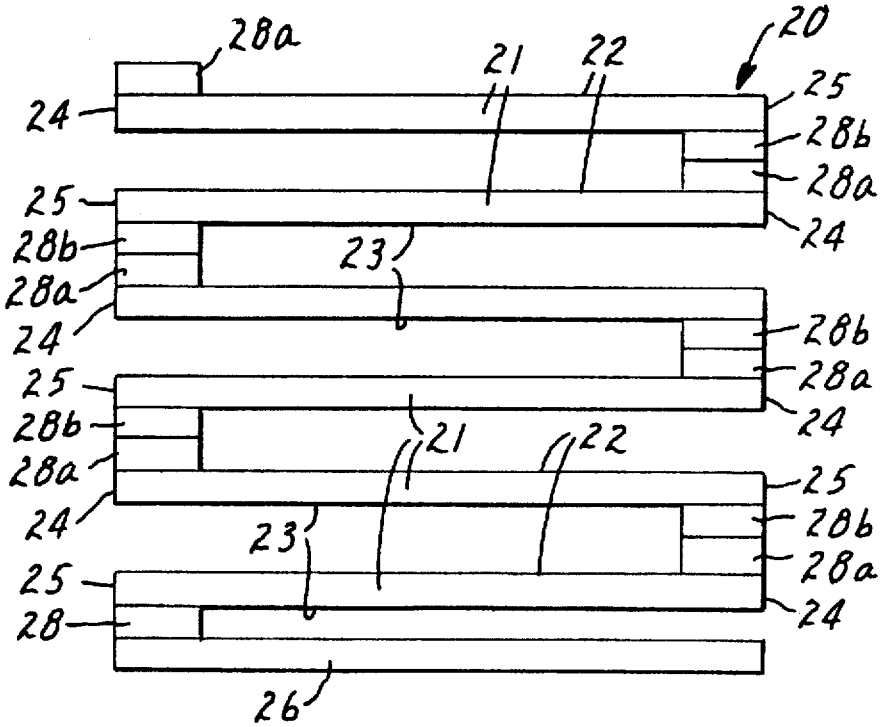
FIG. 3 is a schematic side view of second embodiment of a pad according to the present invention.

Referring now to FIG. 3 of the drawing, there is shown a second embodiment of a pad of sheets according to the present invention generally designated by the reference numeral 20.

Generally the pad 20 comprises a plurality of non folded sheets 21 of the same peripheral size and shape, each sheet 21 having opposite first and second major surfaces 22 and 23 extending between first and second opposite edges 24 and 25. Each of the sheets 21 can, optionally, have graphics 27 printed on either or both of its major surfaces 22 and 23. The sheets 21 are disposed in a stack one on top of another with their peripheral edges in alignment. The pad 20 includes padding means for releasably adhering parts of the first and second major surfaces 22 and 23 of adjacent sheets 21 in the pad 20 together to maintain the sheets 21 in the stack. The padding means comprises each of the sheets 21 having a pattern or band **28*a* of coadhesive coated on its first major surface 22 adjacent its first edge 24, and having a pattern or band 28*b* of coadhesive on its second major surface 23 adjacent its second edge 25. The sheets 21 are stacked with the bands 28*a* and 28*b* of coadhesive on sheets 21 that have sheets 21 adjacent both of their major surfaces 22 and 23 adhered to the bands 28*a* and 28*b* of coadhesive on the adjacent sheets 21 in the pad 20 and releasably adhering parts of the first and second major surfaces 22 and 23 of adjacent sheets 21 in the pad 20 together to maintain the sheets 21 in the stack. The adhered together bands 28*a* and 28*b* of coadhesive on the sheets 21 retain the adjacent sheets 21 in surface to surface relationship until the bands 28*a* and 28*b* of coadhesive are peeled apart. The pad 20, as illustrated, can also include a stiff bottom sheet 26 having a band 28*c* of coadhesive adhered to a band 28*b* of coadhesive on the bottom most sheet 21 in the stack, and optionally could also have a special top sheet (not shown) having a band of coadhesive adhered to the band 18*a* of coadhesive on the adjacent uppermost sheet 21** in the stack.

The locations of the portions of adjacent sheets 21 in the pad 20 that are adhered together alternate between opposite sides of the pad 20 for successive pairs of sheets 21 in the pad 20. Thus, the pad 20 is generally of the type described in U.S. Pat. No. 4,781,306 (Smith) in that sheets 21 from the pad 20 can be withdrawn seriatim when the pad 20 is in a dispenser of the types described in U.S. Pat. Nos. 4,781,306 (Smith), 4,653,666 (Mertens), and 5,080,255 (Windorski), the entire contents of which three patents are hereby incorporated herein by reference.

Figure 4:
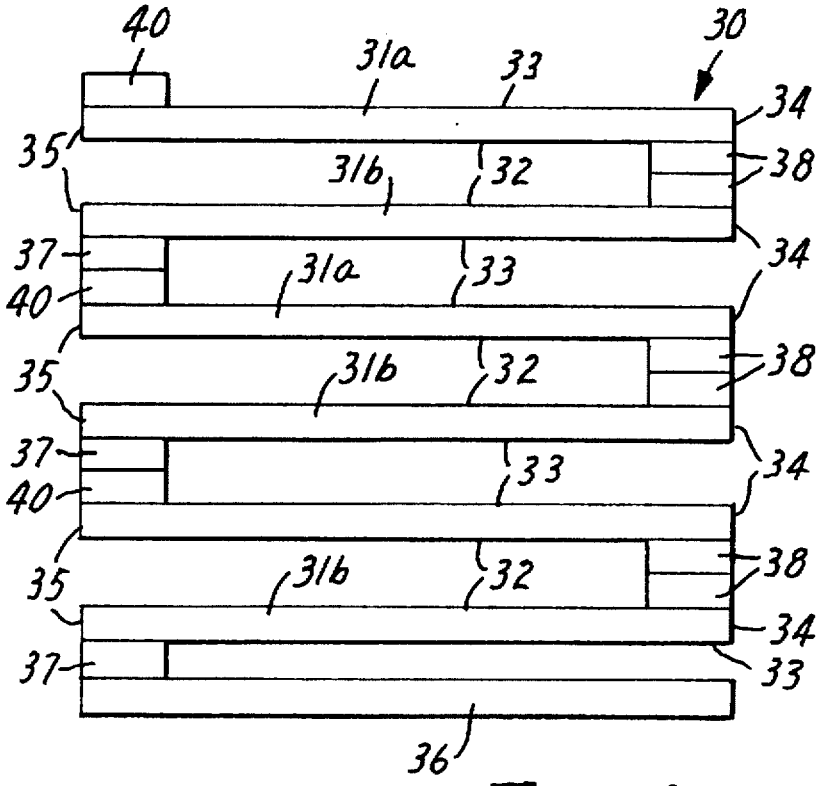
FIG. 4 is a schematic side view of third embodiment of a pad according to the present invention.

Referring now to FIG. 4 of the drawing, there is shown a third embodiment of a pad according to the present invention generally designated by the reference numeral 30.

Generally the pad 30 comprises a plurality of non folded sheets 31*a* and 31*b* of the same peripheral size and shape, each sheet 31*a* and 31*b* having opposite first and second major surfaces 32 and 33 extending between first and second opposite edges 34 and 35. Each of the sheets 31*a* or 31*b* can, optionally, have graphics 37 printed on either or both of its major surfaces 32 and 33. The sheets 31*a* and 31*b* are disposed one on top of another with their peripheral edges in alignment. The pad 30 includes padding means for releasably adhering parts of the first and second major surfaces 32 and 33 of adjacent sheets 31*a* and 31*b* in the pad 30 together to maintain the sheets 31*a* and 31*b* in the stack. That padding means comprises each of the sheets 31*a* and 31*b* having a pattern or band 38 of coadhesive on its first major surface 32 adjacent its first edge 34. Alternating sheets 31*a* and 31*b* throughout the stack have, for each of the first alternating sheets 31*a*, a pattern or band 37 of pressure sensitive adhesive on its second major surface 33 adjacent its second edge 35, and for each of the second alternating sheets 31*b*, a coating 40 of release material on its second major surface 33 adjacent its second edge 35. The sheets 31 are stacked with the bands 38 of coadhesive on adjacent sheets 31 adhered together, and with the band 37 of pressure sensitive adhesive adhered to the second alternating sheet 31*b* over the coating 40 of release material, thereby releasably adhering parts of the first and second major surfaces 32 and 33 of adjacent sheets 31*a* and 31*b* in the stack 30 together to maintain the sheets 31*a* and 31*b* in the stack 30. The adhered together bands 38 of coadhesive on the sheets 31*a* and 31*b* and the bands 37 of pressure sensitive adhesive adhered over the coatings 40 of release material retain the adjacent sheets 31*a* and 31*b* in surface to surface relationship until the bands 38 of coadhesive are peeled apart or the band 37 of pressure sensitive adhesive is peeled away.

The pad 30, as illustrated, can also include a stiff bottom sheet 36 to which a band 37 of pressure sensitive adhesive on the adjacent sheet 31*b* is adhered, and optionally could also have a special top sheet (not shown) appropriately releasably adhered to the adjacent uppermost sheet 31 in the stack.

The locations of the portions of the sheets 31*a* and 31*b* in the pad 30 that are adhered together alternate between opposite sides of the pad 30 for successive pairs of sheets 31*a* and 31*b* in the pad 30. Thus, like the pad 20, the pad 30 is generally of the type described in U.S. Pat. No. 4,781,306 (Smith) in that sheets 31*a* and 31*b* from the pad 30 can be withdrawn seriatim when the pad 30 is in a dispenser of the types described in U.S. Pat. Nos. 4,781,306 (Smith), 4,653, 666 (Mertens), and 5,080,255 (Windorski).

A pad (not illustrated) similar to the pad 30 in that alternating pairs of sheets in the stack are releasably adhered together by patterns or bands of coadhesive on adjacent sheets and by a band of pressure sensitive adhesive could be made in which the bands of coadhesive and the bands of pressure sensitive adhesive are along edges of the sheets on the same side of the stack.

Pads, such as the pads 10, 20 and 30 described above, can be made by (1) coating both side surfaces of a web or length of sheet material with appropriate patterns of coadhesive (or patterns of coadhesive, pressure sensitive adhesive and release material) which can be done by using conventional stripe coating equipment that provides a continuous layer or band of adhesive, or by printing patterns the adhesive or release material onto the sheet material using a flexographic or offset press which can provide a discontinuous layer of adhesive or release material; and (2) converting the adhesive coated length of sheet material into a plurality of pads such as the pads 10, 20, or 30 in which portions of the coating of coadhesive or of the coadhesive and the repositionable pressure sensitive adhesive on the sheets releasably adhere the sheets together in the pads.

That converting step to make the pads can be done by cutting the moving adhesive coated length of sheet material into master sheets of a predetermined size; causing the newly cut master sheets to fall onto a stack of master sheets to form a master pad while jogging the falling master sheet to bring its edges into alignment with the edges of the other master sheets in the master pad; and subsequently cutting the master pad into individual pads (such as the pads 10, 20 or 30) using a shear or die cutting device.

The method described above for making the pads can further include providing either (a) a printing press having printing plates adapted to print indicia along the length of sheet material as it is passed through the press, or (b) a digital electronic printing mechanism adapted to print infinitely variable indicia along the length of sheet material as it is passed through the printing mechanism in response to a series of digital electronic signals to the printing mechanism; and printing indicia on one or both surfaces of the sheets in the pads by passing the moving length of sheet material either (a) through the printing press or (b) through the printing mechanism while sending a series of digital electronic signals to the printing mechanism so that the printing mechanism will print various indicia on either or both of the side surfaces of the length of sheet material. Such printing of the length of sheet material can be done either before or after it is coated with adhesive.

The method described above for adhesive coating and printing the moving sheet material, cutting the master sheets, making the master pads, and subsequently cutting the master pads into individual pads are generally the same as those for making pads described in U.S. patent application No. 08/285,882 filed Aug. 4, 1994, and in PCT International Publication No. WO 94/14614 dated Jul. 7, 1994, (the contents of which application and publication are incorporated herein by reference) except that layers of coadhesive are applied on both major surfaces of at least some of the sheets and in patterns necessary to provide the bands of coadhesive on the sheets in the pads 10, 20 and 30 described above.

As a specific example, pads like the pad 10 each having 50 sheets have been made by applying to a moving length of paper sheet material a thin continuous layer or band of the natural latex or "fugitive" adhesive commercially available from H.B. Fuller Co., St. Paul, Minn., as # W0593. That band was about 0.24 centimeter (3/32 inch) wide and was applied after the length of paper sheet was printed with indicia on a flexographic web press. Master sheets were cut from the end of the moving printed and adhesive coated length of sheet material by a press sheeter, and were then stacked with previously cut master sheets by to form a master pad by a device similar to that described in U.S. Pat. No. 4,102,253 (the content whereof is incorporated herein by reference) so that the edges of the master sheets were aligned within 0.015 in the master stack. The master pad was then removed and cut into individual pads in a guillotine cutting device that applied 2000 pounds per inch holding pressure to the portion of the master pad being cut, with the cut longitudinally bisecting the bands of adhesive so that bands about 0.12 centimeter wide (3/64 inch wide) adhered the sheets in the individual pads together. Those bands of coadhesive held the sheets in place during normal handling of the pads, but allowed individual sheets to be easily peeled off of the tops of the pads. After a sheet was removed from a pad, the bands of coadhesive on the sheet would not adhere to most other surfaces. if desired, however, the sheet could again be adhered to the other sheets in the pad by pressing their bands of coadhesive together.

Pads or cubes like the pad 10 that include well over 100 sheets can be made by that same method, except that the coadhesive should be applied to the sheets in bands about 1.27 centimeter (½ inch) wide on each sheet in the pad, and the cuts with the guillotine cutting device should cut between or across (not longitudinally bisect) the bands of adhesive, as cutting longitudinally through the adhesive of such a large number of sheets can interfere with the cutting action of the cutter. Bands of coadhesive of that width will hold the sheets in place during normal handling of the pad or cube, but will also allow individual sheets to be easily peeled off of the top of the pad. After a sheet is removed from the pad the bands of coadhesive on the sheet will not adhere to most other surfaces. If desired, however, the sheet can again be adhered to the other sheets in the pads by pressing their bands of coadhesive together.

Master pads and individual pads that have no indicia printed on their surfaces can be made using equipment for coating, cutting master sheets, jogging and cutting master pads described above. Also, a master roll of a printed or an unprinted sheet can be made using equipment for coating of the adhesive described above with or without the printer (as appropriate), and then rolling the printed or unprinted sheet into a roll around an axis with opposite edges of the sheet in alignment at the ends of the roll. Such rolls can then be stored and/or shipped to a different location for subsequent printing (if unprinted) and for subsequent conversion into master sheets, master pads, and individual pads in a manner similar to that described above.

The structures and methods according to the present invention have now been described with reference to several embodiments and modifications thereof. It will be apparent to those skilled in the art that many changes can be made in the structures and methods described herein without departing from the scope of the present invention. Thus the scope of the present invention should not be limited to the structures and methods specifically described in this application, but only by structures and methods described by the language of the claims and the equivalents of those structures and methods.

We claim:

1. A pad comprising a plurality of non folded flexible sheets each having opposite first and second major surfaces extending between opposite edges, said sheets being disposed surface to surface in a stack, and padding means for releasably adhering parts of the major surfaces of adjacent sheets in the stack together to maintain the sheets in said stack, said padding means comprising at least some of said sheets having patterns of coadhesive coated on said major surfaces adjacent said edges, said patterns of coadhesive being adhered to patterns of coadhesive on adjacent sheets in the stack and releasably adhering said parts of the major surfaces of adjacent sheets in the stack together in said surface to surface relationship until the patterns of coadhesive are peeled apart.

2. A pad according to claim 1 wherein at least some of said sheets have patterns of coadhesive comprising a first band of coadhesive coated on said first major surface adjacent one of said opposite edges and a second band of coadhesive coated on said second major surface adjacent one of said opposite edges.

3. A pad according to claim 2 wherein said first and second bands of coadhesive on each of said sheets are coated adjacent the same one of said opposite edges.

4. A pad according to claim 2 wherein each of said sheets in said stack that has sheets along both of its major surfaces has said first and second bands of coadhesive and said first and second bands of coadhesive on each of said sheets are adjacent the same one of said opposite edges.

5. A pad according to claim 2 wherein said first and second bands of coadhesive on each of said sheets are adjacent opposite ones of said opposite edges.

6. A pad according to claim 2 wherein each of said sheets in said stack that has sheets along both of its major surfaces has said first and second bands of coadhesive and said first and second bands of coadhesive on each of said sheets are adjacent opposite ones of said opposite edges.

7. A pad according to claim 1 wherein said stack has a plurality of side surfaces defined by the edges of said sheets, with each of said side surfaces having graphics printed on the edges of said sheets.

8. A pad according to claim 1 wherein said padding means further comprises some of said sheets each having a pattern of pressure sensitive adhesive on one of said major surfaces adjacent one of said opposite edges, the pattern of pressure sensitive adhesive releasably adhering together parts of the major surfaces of adjacent sheets in the stack.

9. A pad according to claim 8 wherein pairs of adjacent sheets in said stack are adhered together alternatively by said patterns of coadhesive and by one of said patterns of pressure sensitive adhesive.

10. A pad according to claim 9 wherein said pad has a plurality of side surfaces defined by edges of said sheets, and said patterns of coadhesive and said patterns of pressure sensitive adhesive are along edges of sheets defining the same side surface of said stack.

11. A pad according to claim 9 wherein said pad has a plurality of side surfaces defined by edges of said sheets, and said patterns of coadhesive and said patterns of pressure sensitive adhesive are along edges of sheets defining the opposite side surfaces of said stack.

12. A pad according to claim 1 wherein said sheets have indicia printed along at least one of said major surfaces.

13. A pad according to claim 1 wherein said sheets are of paper.

14. A pad according to claim 1 wherein said sheets are of polymeric film.

15. A master pad comprising a plurality of non folded flexible master sheets each having opposite first and second major surfaces extending between opposite edges, said master sheets being disposed surface to surface in said master pad, and padding means for releasably adhering parts of the major surfaces of adjacent master sheets in the master pad together to maintain the master sheets in said master pad, said padding means comprising at least some of said master sheets having spaced patterns of coadhesive coated on both of said major surfaces, said patterns of coadhesive being adhered to patterns of coadhesive on adjacent master sheets in the master pad and releasably adhering the major surfaces of adjacent master sheets in the master pad together in said surface to surface relationship until the patterns of coadhesive are peeled apart.

16. A master pad according to claim 15 wherein said padding means further comprises some of said master sheets having spaced bands of pressure sensitive adhesive on one of said major surfaces, said bands of pressure sensitive adhesive releasably adhering together parts of the major surfaces of adjacent master sheets in the master pad.

17. A master pad according to claim 16 wherein pairs of adjacent master sheets in said master pad are adhered together alternatively by said spaced bands of coadhesive and by said spaced bands of pressure sensitive adhesive.

18. A master pad according to claim 15 wherein said master sheets have indicia printed along at least one of said major surfaces.

19. A master pad according to claim 15 wherein said master sheets are of paper.

20. A master roll comprising a non folded flexible master sheet having opposite first and second major surfaces extending between opposite edges, said master sheet being wound into the master roll about an axis with said opposite edges generally in alignment at the ends of the roll, and means for releasably adhering parts of the major surfaces of adjacent wraps of the master sheet in the master roll together to maintain the master sheet in said master roll, said means comprising spaced bands of coadhesive coated on both of said major surfaces, said bands of coadhesive on each of said wraps being adhered to bands of coadhesive on adjacent wraps of the master sheet in the master roll and releasably adhering the major surfaces of adjacent wraps in the master roll together in said surface to surface relationship until the bands of coadhesive are peeled apart.

21. A master roll according to claim 20 wherein said means further comprises said master sheet having spaced bands of pressure sensitive adhesive on one of said major surfaces, said spaced bands of pressure sensitive adhesive releasably adhering together parts of the major surfaces of adjacent wraps of the master sheet in the master roll.

22. A master roll according to claim 20 wherein said master sheet has indicia printed along at least one of said major surfaces.

23. A master roll according to claim 20 wherein said master sheet are of paper.

* * * * *